US008608302B2

(12) United States Patent
Nabeshima

(10) Patent No.: US 8,608,302 B2
(45) Date of Patent: Dec. 17, 2013

(54) INKJET PRINTER

(71) Applicant: Canon Kabushiki Kaisha, Tokyo (JP)

(72) Inventor: Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/734,331

(22) Filed: Jan. 4, 2013

(65) Prior Publication Data

US 2013/0120511 A1 May 16, 2013

Related U.S. Application Data

(62) Division of application No. 13/194,481, filed on Jul. 29, 2011, now Pat. No. 8,366,258.

(30) Foreign Application Priority Data

Aug. 24, 2010 (JP) ..... 2010-187225

(51) Int. Cl.
*B41J 2/19* (2006.01)

(52) U.S. Cl.
USPC ..... 347/92

(58) Field of Classification Search
USPC ..... 347/35, 36, 87, 89, 92, 93
See application file for complete search history.

(56) References Cited

U.S. PATENT DOCUMENTS

| | | | | |
|---|---|---|---|---|
| 6,179,406 | B1 * | 1/2001 | Ito et al. | 347/35 |
| 6,520,632 | B1 | 2/2003 | Yamazaki et al. | |
| 6,685,310 | B2 | 2/2004 | Kaga et al. | |
| 7,011,389 | B2 * | 3/2006 | Edamura et al. | 347/36 |
| 7,111,932 | B2 * | 9/2006 | Steed et al. | 347/92 |
| 7,192,132 | B2 | 3/2007 | Suzuki | |
| 7,517,067 | B2 * | 4/2009 | Inoue et al. | 347/92 |
| 7,651,209 | B2 * | 1/2010 | Haines et al. | 347/87 |

FOREIGN PATENT DOCUMENTS

| | | | |
|---|---|---|---|
| CN | 1302732 | A | 7/2001 |
| CN | 1406755 | A | 4/2003 |
| CN | 1590103 | A | 3/2005 |
| JP | 2006-51832 | A | 2/2006 |
| JP | 2006-168224 | A | 6/2006 |

OTHER PUBLICATIONS

Office Action dated Sep. 4, 2013, in Chinese Application No. 201110239139.8.

* cited by examiner

*Primary Examiner* — Kristal Feggins
(74) *Attorney, Agent, or Firm* — Fitzpatrick, Cella, Harper & Scinto

(57) ABSTRACT

A printer includes an ink tank for retaining ink, nozzles for ejecting the ink, an ink flow passage for connecting the ink tank and the nozzles, and a filter chamber in which a filter is arranged. A first room is disposed downstream of the filter and a second room is disposed upstream of filter in the filter chamber. An ink discharge opening is disposed in the first room for supplying the ink to the nozzles. An ink supply opening to which the ink is supplied from the ink tank and an air bubble storage unit for storing air bubbles flowing with the ink are disposed in the second room. The ink supply opening and the ink discharge opening are displaced from each other in a horizontal direction. The air bubble storage unit is arranged upward of the ink discharge opening in such a manner as to sandwich the filter therebetween.

7 Claims, 6 Drawing Sheets

INKJET PRINTER

This application is a divisional of U.S. patent application Ser. No. 13/194,481, filed Jul. 29, 2011.

BACKGROUND OF THE INVENTION

1. Field of the Invention

The present invention relates to an inkjet printer in which a filter is arranged in an ink flow passage, and in more detail, to an inkjet printer which can efficiently execute storage and discharge of air bubbles flowing in an ink flow passage in which a filter is arranged.

2. Description of the Related Art

An inkjet printer (hereinafter, called "printer" simply) is provided with a filter disposed in an ink flow passage for removing foreign objects and air bubbles in the ink flow passage in such a manner as to accurately eject liquids (ink) from inkjet nozzles. The air bubbles removed by the filter are stored in the ink flow passage, pass through the filter in a recovery operation for each constant interval, and are discharged from the inkjet nozzles.

The filter removes the foreign object or the air bubbles to create excellent printing, and on the other hand, attachment of the air bubbles to the filter increases pressure losses of the filter depending on ink properties or an ink flow amount and raises a problem of causing a print failure.

At the time of discharging the air bubbles removed with the filter in the recovery operation, since the ink is also discharged simultaneously, it is necessary to restrict an ink amount to be discharged by extending the recovery interval (that is, reducing the number of times of the recovery operations), for example.

The following measures are proposed for solving these problems.

The first measure is to dispose an evacuation space in the upward direction of gravity (upward in the perpendicular direction) upstream of the filter. In consequence, it is possible to remove the air bubbles flowing together with the ink by the filter and to let out the air bubbles into the evacuation space.

The second measure is to reduce pressures in a filter portion at recovery operation for pressing a deformable member of the filter portion against the filter. Inconsequence, there is proposed an inkjet printer which increases a discharge efficiency of the air bubble, extends the recovery interval, and restricts an ink amount to be discharged.

Japanese Patent Laid-Open No. 2006-168224 discloses the construction corresponding to the first measure as described above, in which the ink is separated from the air bubble by the filter and the air bubble is let out to the evacuation space. However, an ink introducing port and an ink feeding port are arranged substantially on a straight line and there is almost no ink stream for guiding the air bubble to the evacuation space. Therefore, in a case where the ink stream is sequential, the air bubble is attached to the filter depending on ink properties or a size of the air bubble and an ink flow amount, which reduces an effective area of the filter. Thereby the pressure loss is increased, thus creating a possibility of causing a printing failure. In addition, since the evacuation space is right above the filter, when the ink flow amount is increased, the pressure in the filter portion is decreased and the separated air bubble is expanded, there is a possibility that the air bubble is again involved in the ink stream.

Japanese Patent Laid-Open No. 2006-051832 discloses the construction corresponding to the second measure as described above, in which the deformable member is pressed against the filter for improving the discharge efficiency of the air bubble. According to this construction, the deformable member requires flexibility, and further, since the flexibility is difficult to be compatible with a percolation performance of water vapors or gases of the deformable member itself, there is a possibility that the air bubbles grow due to gas percolation from the deformable member to inhibit extension of the recovery interval.

SUMMARY OF THE INVENTION

An object of the present invention is to provide an inkjet printer which can securely separate air bubbles from an ink stream for storage to restrict filter clogging due to the air bubbles, and can extend a recovery interval by efficient air bubble discharge.

In order to achieve the above object, the present invention is provided with an inkjet printer comprising at least an ink tank for retaining ink, inkjet nozzles for ejecting the ink to perform a print, an ink flow passage for connecting the ink tank and the inkjet nozzles, a filter disposed in the middle of the ink flow passage, and suction means for sucking the ink through the inkjet nozzles in recovery, further comprising opening and closing means for opening and closing the ink flow passage, and a filter chamber in which the filter is arranged horizontally, wherein the opening and closing means is disposed upstream of the filter chamber, a first room is disposed downstream of the filter and a second room is disposed upstream of the filter in the filter chamber, an ink discharge opening is disposed in the first room for supplying the ink to the inkjet nozzles, an ink supply opening to which the ink is supplied from the ink tank and an air bubble storage unit for storing the air bubble flowing in with the ink are disposed in the second room, the ink supply opening and the ink discharge opening arranged to sandwich the filter are displaced with each other in a horizontal direction for arrangement, the air bubble storage unit is arranged upward of the ink supply opening in a perpendicular direction and is arranged to oppose the ink discharge opening in such a manner as to sandwich the filter therebetween, and the suction means expands the air bubble stored in the air bubble storage unit to a size equal to or more than that of the second room.

Since the present invention is constructed as described above, to the air bubble having flowed in from the ink supply opening, a buoyant force is generated in a direction directly opposite to a force in the gravity downward direction (downward in the perpendicular direction) caused by the ink stream. In consequence, it is restricted that the air bubble is pressed against the filter by the ink stream to stay in close contact with the filter. Further, since the air bubble is subjected to a force acting toward the air bubble storage unit from the ink stream, the air bubble can be easily stored in the air bubble storage unit. In addition, since the air bubble storage unit is disposed upward of the ink supply opening in the perpendicular direction, the air bubble stored in the air bubble storage unit is prevented from being involved in the ink stream to be attached to the filter.

As a result, since it is possible to furthermore restrict the attachment of the air bubble to the filter, the ink can be supplied to the inkjet nozzles without damaging the effective area of the filter to perform a preferable print.

Further, since the stored air bubble is reduced in pressure more than in the second room and expanded to be discharged, the flexibility is not required as a material of the second room and a material low in the percolation performance of water vapors and gases can be selected. Therefore, evaporation of the ink from the second room or percolation of the gases into the second room can be restricted to restrict growth of the air bubble, extending the recovery period.

According to the present invention, a volume of the air bubble storage unit is set to be larger than a total volume of a volume of remaining air bubbles at recovery completion and a volume of inflow air bubbles flowing in by the time of the next recovery.

According to this construction, since the remaining air bubbles and the inflow air bubbles stored in the air bubble storage unit are positioned above the ink supply opening in the gravity upward direction (upward in the perpendicular direction), the air bubbles are difficult to be involved in the ink stream and more difficult to be attached to the filter. Therefore, since the attachment of the air bubble to the filter is restricted between the current recovery and the next recovery, the ink can be supplied to the inkjet nozzles without damaging the effective area of the filter to perform the preferable print.

The present invention is further constructed such that an angle between a straight line connecting the ink supply opening with the ink discharge opening and the filter arranged horizontally is equal to or less than 45°.

According to this construction, the force directing the inflow air bubble flowing in from the ink supply opening toward the air bubble storage unit is larger than the force pressing it against the filter. As a result, also in the higher-speed ink stream, the ink can be supplied to the inkjet nozzles without damaging the effective area of the filter to perform the preferable print.

According to these constructions, the clogging due to the attachment of the air bubbles to the filter can be restricted, and since reduction of the effective area of the filter can be restricted by them, it is possible to expand the corresponding range of the ink properties or the ink flow amount. In addition, since the growth of the air bubble in the air bubble storage unit can be restricted, it is possible to extend the recovery interval to reduce the waste ink amount.

Further features of the present invention will become apparent from the following description of exemplary embodiments (with reference to the attached drawings).

DESCRIPTION OF THE EMBODIMENTS

Figure 1:
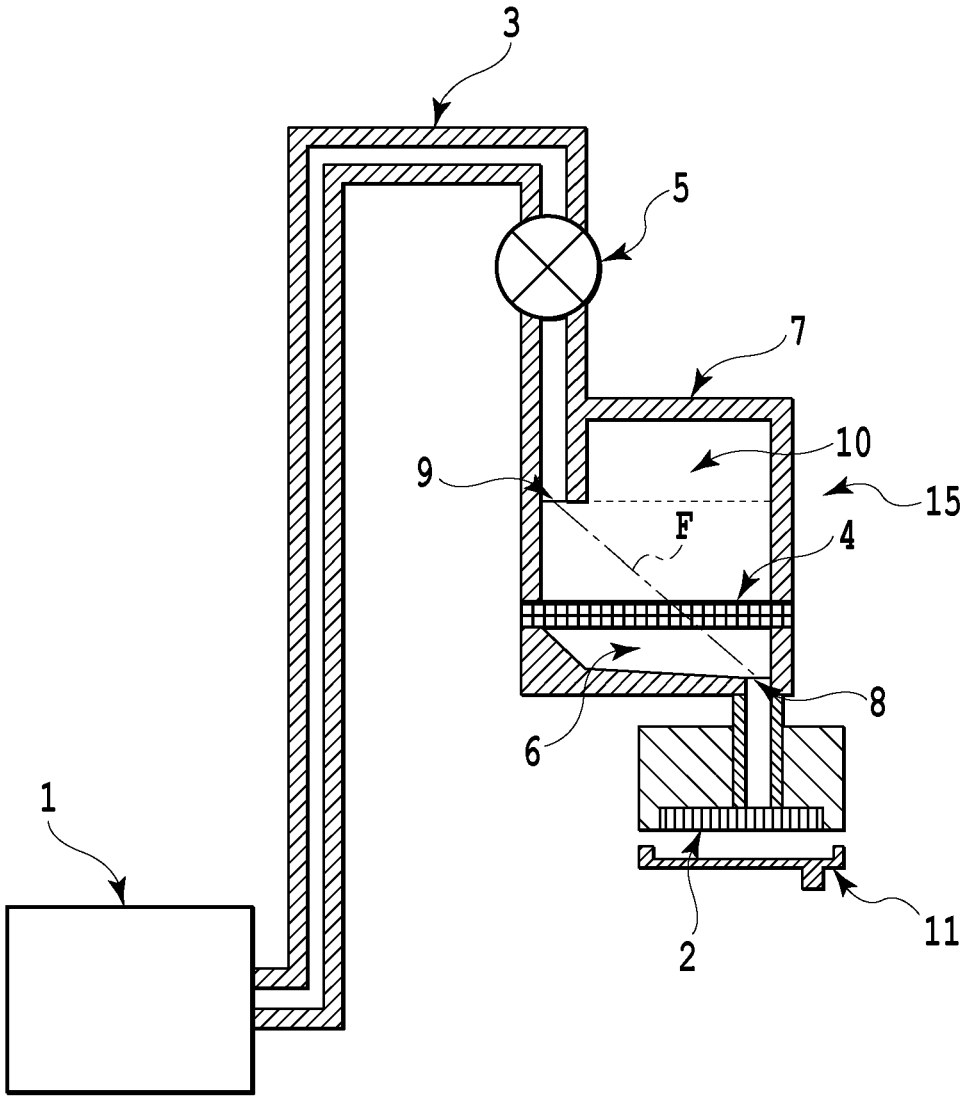
FIG. 1 is a schematic diagram explaining the construction of an inkjet printer in a first embodiment according to the present invention.

Hereinafter, embodiments according to the present invention will be explained with the accompanying drawings. FIG. 1 is a schematic diagram explaining the construction of an inkjet printer in a first embodiment according to the present invention.

As shown in FIG. 1, the inkjet printer according to the present embodiment is provided with an ink tank 1 for retaining ink and inkjet nozzles 2 for ejecting the ink to perform a print, wherein the ink tank 1 and the inkjet nozzles 2 are connected by an ink flow passage 3. In the middle of the ink flow passage 3 connecting the ink tank 1 and the inkjet nozzles 2, there are provided opening and closing means 5 for opening and closing the ink flow passage 3 and a filter chamber 15 in which a filter 4 is arranged horizontally, from the upstream side (that is, from the side of the ink tank 1). The inkjet printer is further provided with suction means 11 for coming in close contact with the inkjet nozzles 2 in recovery to seal them and sucking the ink through the inkjet nozzles 2. The opening and closing means 5, the filter chamber 15 and the suction means 11 constitute an air-bubble storage and discharge mechanism.

A first room 6 provided with an ink discharge opening 8 for supplying the ink to the inkjet nozzles 2 from the filter chamber 15 is disposed downstream of the filter 4 arranged horizontally in the filter chamber 15. In the present embodiment, the ink supplied from the filter chamber 15 to the inkjet nozzles 2 flows in the gravity downward direction (downward in then perpendicular direction). In addition, a second room 7 provided with an ink supply opening 9 to which the ink is supplied from the ink tank 1 and an air bubble storage unit 10 for storing air bubbles are disposed upstream of the filter 4 arranged horizontally in the filter chamber 15.

Figure 2:
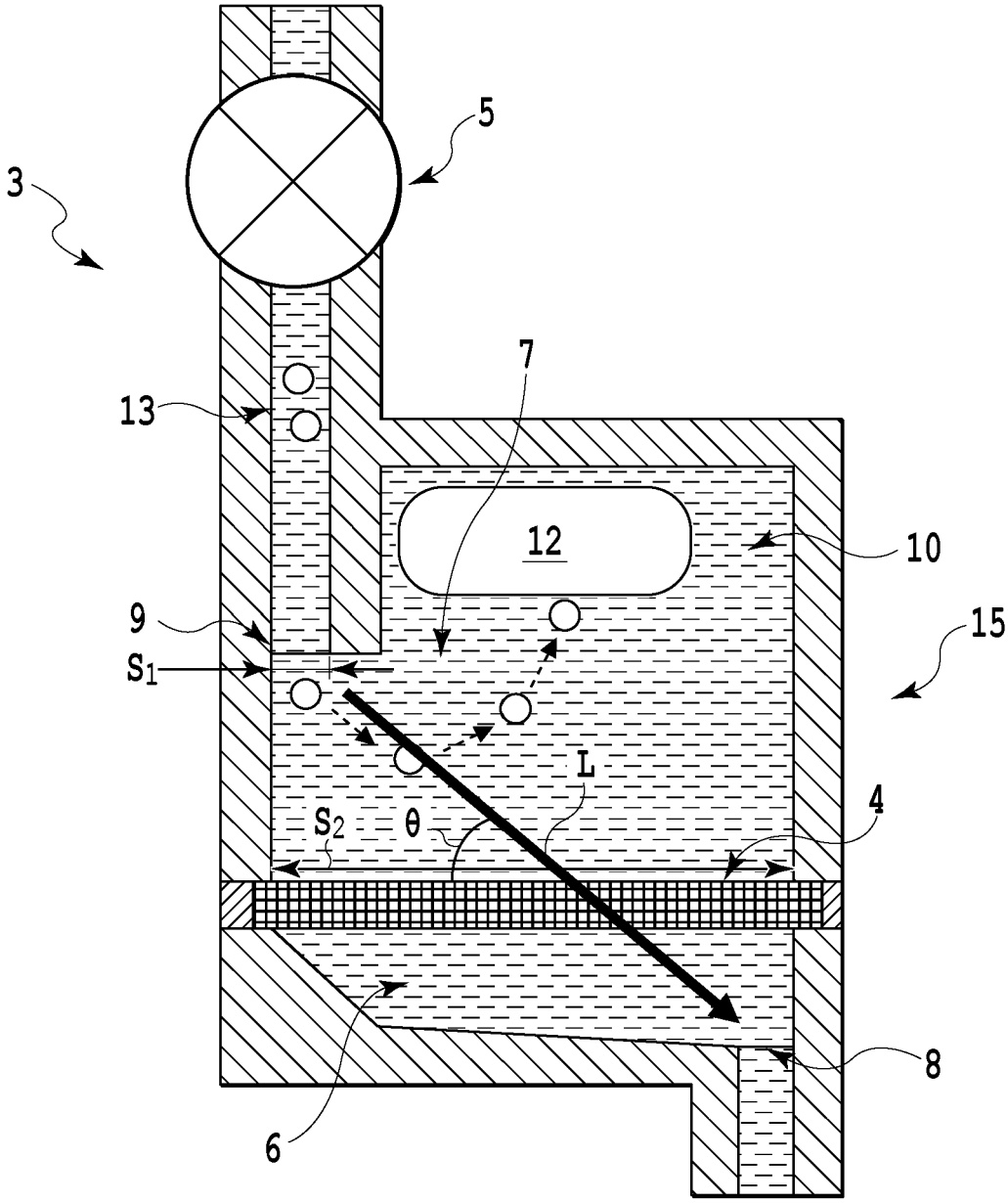
FIG. 2 is a schematic diagram explaining behaviors of air bubbles in a filter chamber of the printer in FIG. 1.

As apparently shown in FIG. 1 and FIG. 2, the ink supply opening 9 and the ink discharge opening 8 in the filter chamber 15 are open to the filter chamber 15 in positions sandwiching the filter 4 and displaced with each other in the horizontal direction. The wording "(be) displaced in the horizontal direction" herein means that a center of the ink supply opening 9 and a center of the ink discharge opening 8 are disposed not in positions directly opposite to the filter 4 but in positions in the slant downward direction. That is, the ink supply opening 9 and the ink discharge opening 8 are arranged in such a manner that a straight line (F) connecting the respective centers or a streamline (arrow mark L) of ink flowing in the filter chamber 15 is inclined (at an angle of θ (less than 90°)) to the filter 4 horizontally arranged.

In the present embodiment, in the ink supply opening 9 open to the second room 7 in the filter chamber 15, the opening surface of the ink supply opening 9 is arranged horizontally and the horizontal cross-sectional area S1 thereof is set smaller than the horizontal cross-sectional area S2 in the filter 4 (S2>S1). It should be noted that in the present embodiment, the ink discharge opening 8 open to the first room 6 in the filter chamber 15 is also arranged horizontally and the horizontal cross-sectional area is S1 which is the same as that of the ink supply opening 9. However, the horizontal cross-sectional area of the ink discharge opening 8 may be different from the horizontal cross-sectional area S1 of the ink supply opening 9.

The air bubble storage unit 10 in the second room 7 is provided in a position opposing the ink discharge opening 8 open to the first room 6 to sandwich the filter 4 therebetween. The air bubble storage unit 10 is, as shown apparently in FIG. 2, formed in a position above the ink supply opening 9, which is open in the horizontal direction in the second room 7 of the filter chamber 15, in the gravity upward direction (upward in the perpendicular direction).

The behavior of the air bubble in the filter chamber as constructed in this manner will be explained with reference to FIG. 2 and FIG. 3. FIG. 2 is a schematic diagram showing a state in which inflow air bubbles 13 are stored in the air bubble storage unit 10 during ink using.

As shown in FIG. 2, in the present embodiment, the air bubbles 13 flow into the second room 7 in the gravity downward direction (downward in the perpendicular direction) from the ink supply opening 9 together with the ink supplied through the ink flow passage 3. When the air bubble 13 having flowed in, since the cross-sectional area S1 of the ink supply opening 9 is smaller than the cross-sectional area S2 of the filter 4, passes the ink supply opening 9 and enters into the second room 7, the speed slows down. In addition, the inflow air bubble 13 changes the flow direction toward the ink discharge opening 8 to flow along a streamline L inclined at an angle of θ (less than 90°) to the horizontal line. Therefore, it is understood that component forces respectively in the perpendicular direction and in the horizontal direction act on the air bubble 13. A buoyant force acts further on the air bubble 13 itself in the gravity upward direction (upward in the perpendicular direction). The air bubble 13 is guided to the air bubble storage unit 10 by the component force in the horizontal direction and the buoyant force acting on the air bubble 13.

In this case, the component force (force for pulling the air bubble 13 in the direction of the filter 4) acting on the air bubble 13 in the gravity downward direction (downward in the perpendicular direction) is reduced to be smaller as compared to a case where the streamline L is formed toward the downward side in the perpendicular direction (that is, an angle θ between the streamline L and the horizontal line is 90°). On the other hand, as the angle θ (less than 90°) of the streamline L is the smaller, the component force toward the horizontal direction (force for pulling the air bubble 13 in the direction of the air bubble storage unit 10) acting on the air bubble 13 is larger. Therefore, as the angle θ (less than 90°) of the streamline L is the smaller, the air bubble 13 having flowed into the second room 7 can be more easily guided to the air bubble storage unit 10 formed above the ink supply opening 9 in the perpendicular direction by the component force in the horizontal direction and the buoyant force. It should be noted that the angle θ (less than 90°) of the streamline L to the filter 4 horizontally arranged (that is, the horizontal line) is preferably smaller than 45° since the component force in the horizontal direction is larger than the component force in the perpendicular direction. In addition, an angle between a straight line connecting a center of the ink supply opening and a center of the ink discharge opening, which forms the streamline L, and the filter is preferably smaller than 45°.

As a result, the air bubble 13 flowing into the second room 7 in the filter chamber 15 can be separated from the ink stream below the air bubble storage unit 10 to be stored in the air bubble storage unit 10 without staying in close contact with the filter 4. A partial region of the filter chamber formed upward of the dotted line in FIG. 1 is defined as the air bubble storage unit 10.

Figure 3:
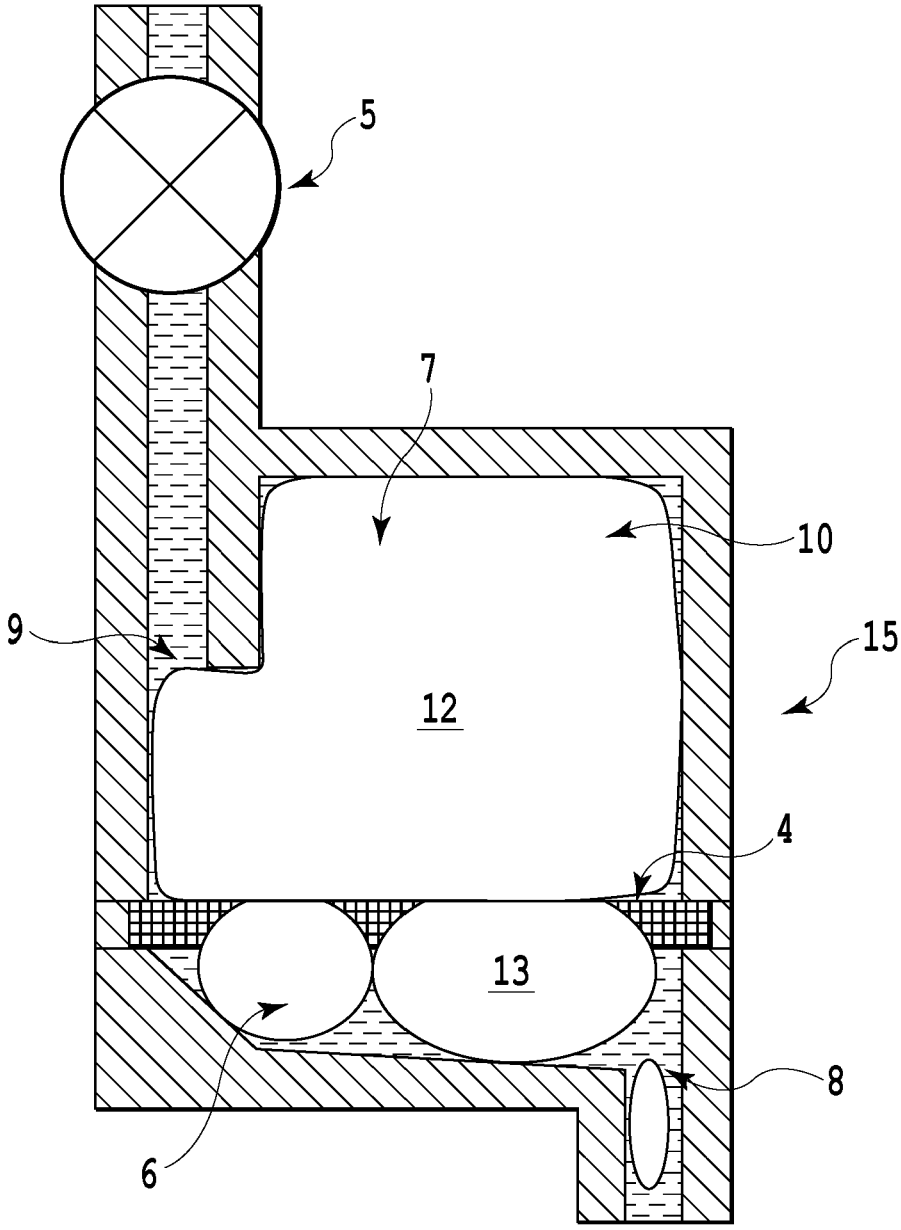
FIG. 3 is a schematic diagram explaining discharge of air bubbles in the filter chamber of the printer in FIG. 1.

FIG. 3 is a schematic diagram showing a state where air bubbles stored in the air bubble storage unit 10 are discharged during a recovery operation. In the present embodiment, the air bubbles 12 stored in the air bubble storage unit 10 are discharged through the inkjet nozzles 2 following the recovery operation performed for each predetermined period.

For discharging the air bubbles 12 and 13 stored in the air bubble storage unit 10, it is necessary for the air bubbles 12 and 13 to pass through the filter 4. For the reason, first, the ink flow passage 3 is closed by the opening and closing means 5, and next, an internal pressure in the ink flow passage 3 downstream of the opening and closing means 5 is reduced through the suction means 11 which is in close contact with and seals the inkjet nozzles 2. Following the reduction in pressure in the ink flow passage 3, the air bubbles 12 and 13 stored in the air bubble storage unit 10 expand to fill the second room 7 and to be in contact with the filter 4. By further reducing the pressure in the ink flow passage 3 to break a meniscus of the ink attached on the filter 4, the air bubbles 12 and 13 expand in size more than a size of the second room 7, which then pass through the filter 4 and are discharged to an outside through the inkjet nozzles 2 and the suction means 11.

According to the air bubble discharging method in the present embodiment, at recovery completion, the internal pressure in the ink flow passage is returned back to the internal pressure at ink using and thereby the air bubbles 12 left upstream of the filter 4 are contracted and are returned as the remaining air bubbles 12 in the air bubble storage unit 10 by the buoyant force. Accordingly, for preventing the remaining air bubbles 12 and the inflow air bubbles 13 flowing in by the time of the next recovery operation from being involved in the ink stream and being pressed against the filter 4, a capacity of the air bubble storage unit 10 is more preferably set to be defined according to the following relation formulas (1) and (2).

Volume of Air bubble storage unit≥(Volume of Air bubbles Remaining in Air bubble storage unit after Recovery operation+Volume of Air bubbles Flowing into Air bubble storage unit in Period of Recovery interval) Formula (1)

According to the above formula (1), the air bubbles in the air bubble storage unit do not overflow in such a manner as to seal the ink supply opening 9, thus making it possible to always stably store the air bubbles therein.

Volume of Air bubble storage unit ≥(Ultimate absolute pressure of Second room in Recovery operation/ Absolute pressure of Second room in Ink use)× (Volume of Second room) Formula (2)

According to the above formula (2), the volume of the air bubbles expanded in the recovery operation (a pressure of the volume of the expanded air bubbles is defined as an ultimate absolute pressure) is larger than the volume of the second room in the ink use (a pressure of the volume in the second room is defined as an absolute pressure), which breaks the meniscus of the filter 4 to easily push out the air bubbles into the first room.

Since the present embodiment is constructed as described above, the event of damaging the effective area of the filter 4 due to the attachment of the air bubbles 12 and 13 to the filter 4 can be prevented and therefore, the ink can be supplied to the inkjet nozzles 2 by a required and sufficient amount to perform a preferable print. In addition, in the present embodiment, the air bubbles 12 and 13 stored in the air bubble storage unit 10 (air bubbles remaining in the air bubble storage unit and air bubbles flowing into the air bubble storage unit by the time of the next recovery operation) expand from the corner to the corner in the second room 7 which will be filled with the air bubbles at recovery operation. Thereby, the meniscus of the ink attached onto the filter 4 is broken, and at least an amount corresponding to a volume of the inflow air bubbles 13 is discharged. In this manner, since it is not necessary to form the second room 7 of a material having flexibility in the present embodiment for discharging the air bubbles 12 and 13, the material selectivity of the second room 7 is high and growth of the air bubble due to the gas percolation to the material can be restricted to be small.

As a result, in the present embodiment, it is possible to set the recovery interval for discharging the air bubbles to be longer, thereby reducing the waste ink amount.

It should be noted that in the present embodiment, the filter 4 is horizontally arranged, that is, perpendicularly to the gravity direction, but not limited thereto; the filter 4 may be slightly inclined. In other words, the filter 4 is arranged downward of the ink supply opening 9 and the air bubble storage unit 10 is arranged upward of the ink supply opening 9, so that the filter 4 and the air bubble storage unit 10 may be arranged to be spaced with each other in the gravity direction.

In the present embodiment, as shown in FIG. 1 to FIG. 3, the ink supply opening 9 and the ink discharge opening 8 are formed such that an opening surface of each is in parallel with the filter 4, but not limited thereto. It is apparent that the operational effect of the air bubble storage and discharge mechanism according to the present invention does not depend on the direction of the opening surface. Therefore, in the ink supply opening 9, as shown as a second embodiment of the present invention in FIG. 4, the opening surface may be opened to be perpendicular to the filter 4.

Further, in the construction of the printer shown in FIG. 1, the ink tank 1 is arranged in the gravity downward direction (downward in the perpendicular direction) to the inkjet nozzles 2, and a negative pressure of the inkjet nozzle 2 is maintained by a water head difference. However, the printer to which the present invention is applied is not limited thereto and, for example, may be constructed such that a sub tank having a pressure adjusting function is mounted to maintain a negative pressure of the inkjet nozzle 2, and the ink tank 1 is arranged freely.

Figure 4:
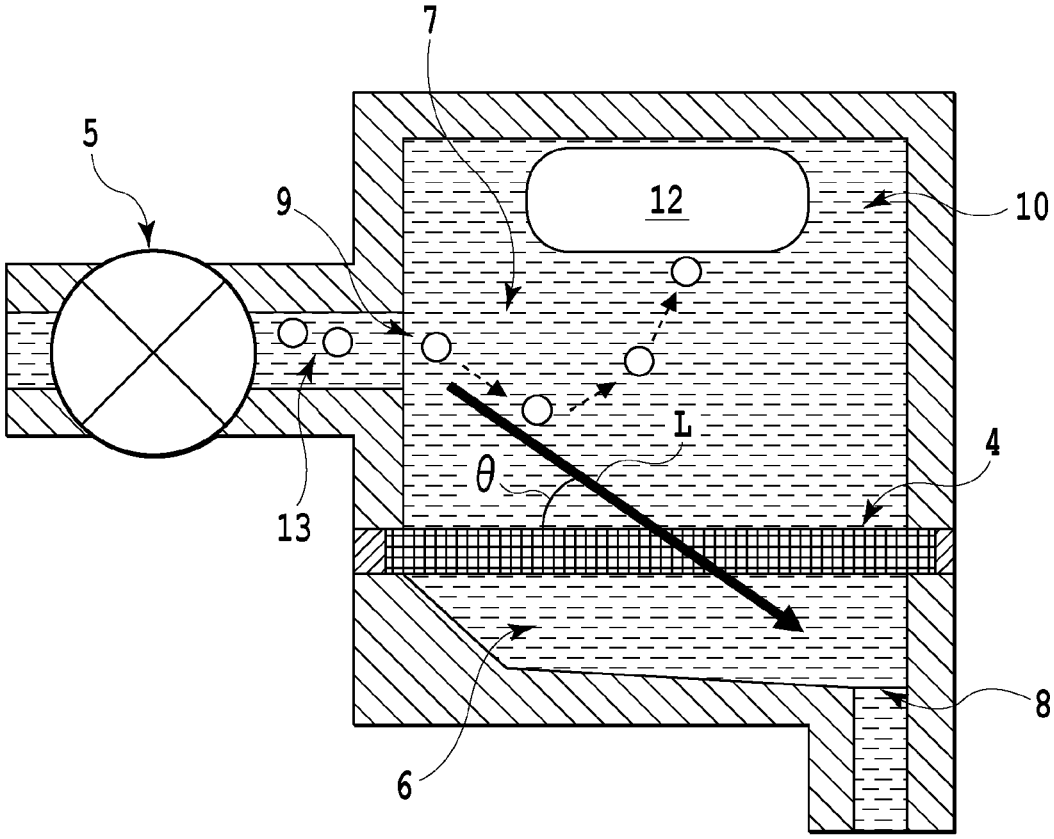
FIG. 4 is a schematic diagram explaining an inkjet printer in a second embodiment according to the present invention and similar to FIG. 2.

Here, a second embodiment according to the present invention will be briefly explained with reference to FIG. 4. The second embodiment according to the present invention shown in FIG. 4 has the construction which is completely the same as that of the first embodiment explained with reference to FIG. 1 to FIG. 3 except that the flow of the ink introduced into the filter chamber 15 is in the horizontal direction. Also in the present embodiment shown in FIG. 4, the ink supply opening 9 and the ink discharge opening 8 in the filter chamber 15 are opened to the filter chamber 15 in the positions displaced with each other in the horizontal direction to sandwich the filter 4 therebetween. That is, the ink supply opening 9 and the ink discharge opening 8 are arranged in such a manner that a straight line connecting the ink supply opening 9 and the ink discharge opening 8 is formed at an angle of θ (less than 90°) to the filter 4 horizontally arranged. In addition, in the ink supply opening 9 open to the second room 7 in the filter chamber 15, the opening surface is arranged perpendicularly, but the perpendicular cross-sectional area is set smaller than the horizontal cross-sectional area in the filter 4. Further, the filter 4 is arranged downward of the ink supply opening 9 and the air bubble storage unit 10 is arranged upward of the ink supply opening 9. Therefore, the filter 4 and the air bubble storage unit 10 are arranged to be spaced with each other in the gravity direction (perpendicular direction). Accordingly, it should be understood that also in the second embodiment according to the present invention shown in FIG. 4, the operational effect similar to that of the first embodiment can be achieved.

Next, an inkjet print head to which the present invention is applied will be explained with reference to FIG. 5 and FIG. 6.

Figure 5:
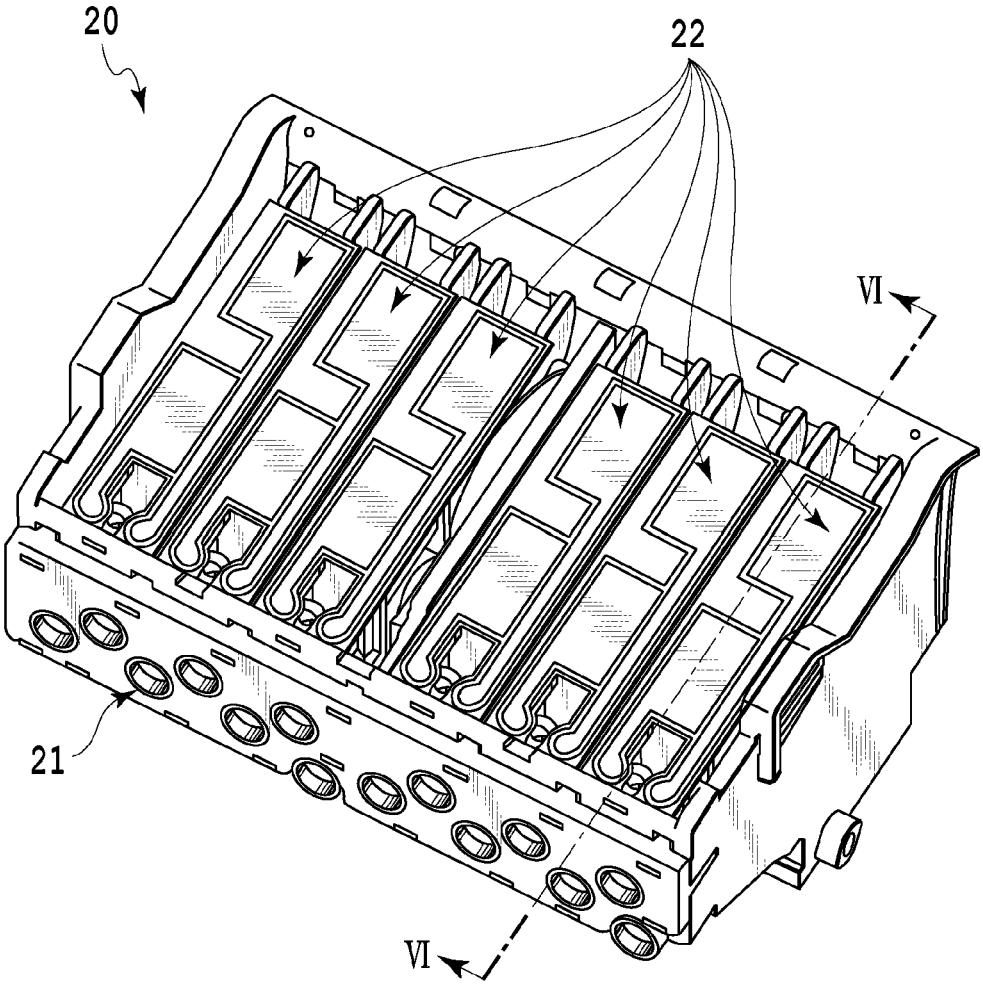
FIG. 5 is a perspective view of an inkjet printer head to which the present invention is applied.
Figure 6:
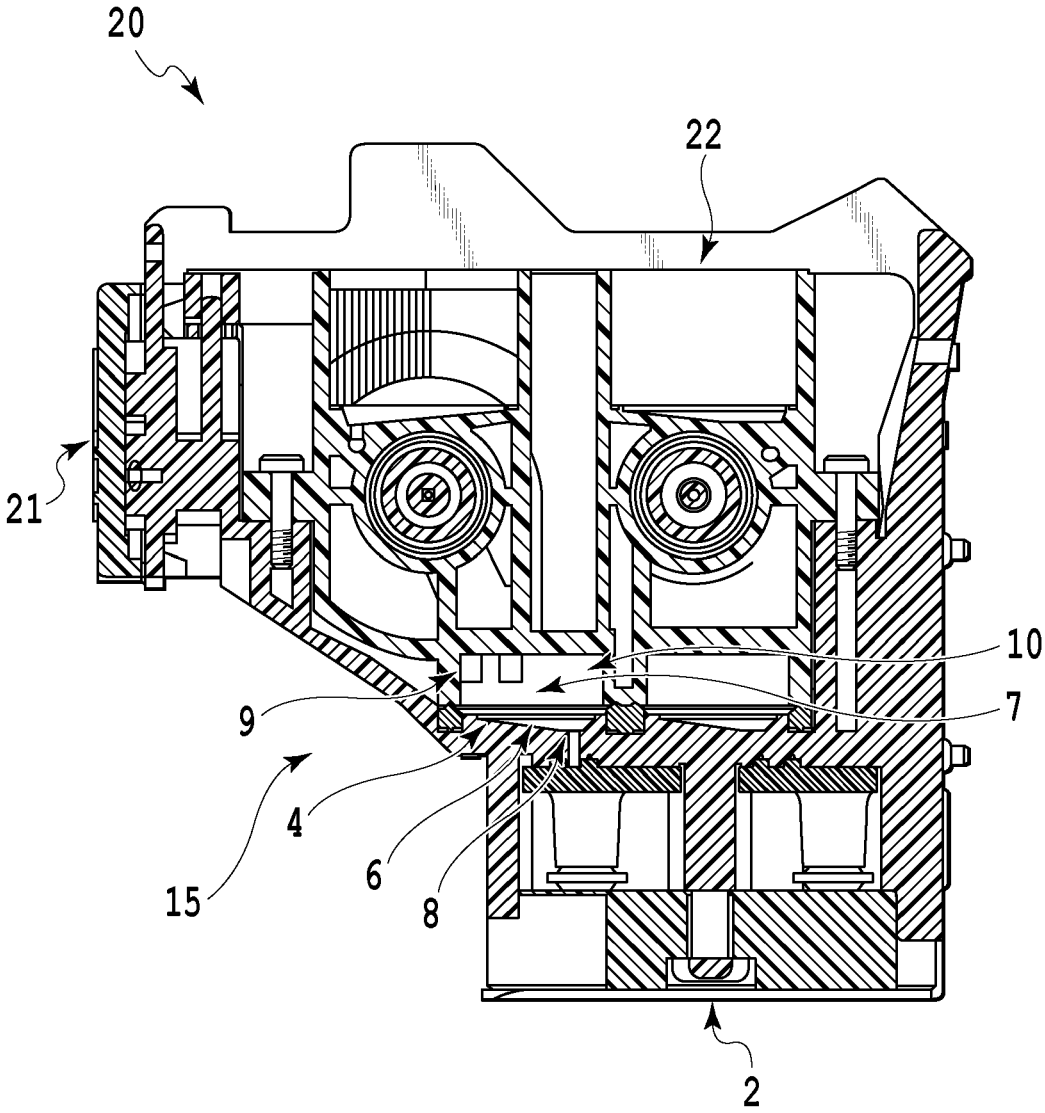
FIG. 6 is a cross section taken along line VI-VI in FIG. 5.

An inkjet print head 20 shown in FIG. 5 and FIG. 6 receives supply of ink from the ink tank 1 (refer to FIG. 1) and ejects the ink from the inkjet nozzles 2 to perform a print. The inkjet print head 20 is provided with a joint 21 connecting the ink flow passage 3 thereto, a sub tank 22 adjusting a pressure for optimally performing the print, and the inkjet nozzles 2 ejecting the ink for printing. The filter chamber 15 constituting the air bubble storage and discharge mechanism according to the first embodiment in the present invention is provided between the sub tank 22 and inkjet nozzles 2. It should be noted that the opening and closing means 5 is provided upstream of the joint 21 (not shown).

As described above, in the filter chamber 15 the filter 4 is arranged horizontally, that is, perpendicularly to the gravity direction. The second room 7 having the ink supply opening 9 and the air bubble storage unit 10 is arranged upstream of the filter 4 and the first room 6 having the ink discharge opening 8 is provided downstream of the filter 4. The air bubble storage unit 10 is arranged upward in the perpendicular direction (gravity upward direction) of the ink supply opening 9.

The inflow air bubble flowing into the sub tank 22 together with the ink supplied from the joint 21 or the air bubble 13 (refer to FIG. 2) passing through the sub tank 22 flows into the second room 7 from the ink supply opening 9. The inflow air bubble 13 having flowed into the second room 7 is separated from the ink stream L by the force received from the ink stream L (refer to FIG. 2) directed in the ink discharge opening 8 and the buoyant force, and is stored in the air bubble storage unit 10 together with the remaining air bubble 12 (refer to FIG. 3) already stored. Since the air bubble 12 (refer to FIG. 3) stored in the air bubble storage unit 10 is stored upward of the ink supply opening 9 in the gravity direction (upward in the perpendicular direction) in light of the formula (1), the air bubble 12 is not involved in the ink stream L or is not pressed against the filter 4. As a result, a preferable print can be performed without reducing the effective area of the filter 4.

In recovery, the opening and closing means 5 is closed to reduce the internal pressure in the ink flow passage 3. Following the reduction in pressure in the ink flow passage 3, the air bubbles 12 and 13 stored in the air bubble storage unit 10 expand to fill the second room 7 therewith and to be in contact with the filter 4. By further reducing the pressure in the ink flow passage 3 to break a meniscus of the ink attached onto the filter 4, the air bubbles 12 and 13 expand in size more than a size of the second room 7, which then pass through the filter 4 and are discharged to an outside through the inkjet nozzles 2 and the suction means 11. The pressure of breaking the meniscus of the ink is determined by fineness of a mesh of the filter 4, ink properties and the like.

As described above, since the internal pressure in the ink flow passage 3 is back to the pressure in ink use after the recovery and simultaneously the expanded air bubble 12 is contracted, the remaining air bubble 12 remains in the air bubble storage unit 10, and the expansion and the contraction are repeated for each recovery operation. Since the inflow air bubble 13 flowing in a period between the current recovery and the next recovery is discharged due to the expansion of the remaining air bubble 12, the second room 7 can discharge the inflow air bubble 13 from the air bubble storage unit 10 in the second room 7 with no necessity of the specific configuration or the flexibility. As a result, the recovery interval for discharging the air bubble can be set longer to reduce the waste ink amount.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-187225, filed Aug. 24, 2010, which is hereby incorporated by reference herein in its entirety.

What is claimed is:

1. A printer comprising:

an ink tank for retaining ink;

nozzles for ejecting the ink;

an ink flow passage for connecting the ink tank and the nozzles; and a filter chamber in which a filter is arranged, wherein a first room is disposed downstream of the filter and a second room is disposed upstream of filter in the filter chamber, an ink discharge opening is disposed in the first room for supplying the ink to the nozzles, an ink supply opening to which the ink is supplied from the ink tank and an air bubble storage unit for storing air bubbles flowing with the ink are disposed in the second room, the ink supply opening and the ink discharge opening are displaced from each other in a horizontal direction, and the air bubble storage unit is arranged upward of the ink discharge opening in such a manner as to sandwich the filter therebetween.

2. The printer according to claim 1, further comprising suction means for sucking the ink through the nozzles during a recovery operation.

3. The printer according to claim 2, wherein the volume of the air bubble storage unit meets the following relation:

Volume of air bubble storage unit≥(Volume of air bubbles remaining in air bubble storage unit after recovery operation+Volume of air bubbles flowing into air bubble storage unit in period of recovery interval).

4. The printer according to claim 2, wherein the volume of the air bubble storage unit meets the following relation:

Volume of air bubble storage unit≥(Ultimate absolute pressure in second room at recovery operation/Absolute pressure in second room at ink use)×(Volume of second room).

5. The printer according to claim 1, wherein the angle between a straight line connecting a center of the ink supply opening and a center of the ink discharge opening and the filter is smaller than 45°.

6. The printer according to claim 1, wherein a horizontal cross-sectional area of the ink supply opening is smaller than a horizontal cross-sectional area of the filter.

7. The printer according to claim 1, wherein a flow of the ink introduced into the filter chamber is in a horizontal direction.

* * * * *